US010428561B2

(12) United States Patent
Ottolini

(10) Patent No.: US 10,428,561 B2
(45) Date of Patent: Oct. 1, 2019

(54) VERIFICATION SYSTEM FOR A VEHICLE LATCH AND METHOD

(71) Applicant: Inteva Products, LLC, Troy, MI (US)

(72) Inventor: Philippe Ottolini, La Voivre (FR)

(73) Assignee: INTEVA PRODUCTS, LLC, Troy, MI (US)

( * ) Notice: Subject to any disclaimer, the term of this patent is extended or adjusted under 35 U.S.C. 154(b) by 152 days.

(21) Appl. No.: 15/633,183

(22) Filed: Jun. 26, 2017

(65) Prior Publication Data

US 2018/0002955 A1 Jan. 4, 2018

(30) Foreign Application Priority Data

Jun. 29, 2016 (FR) ..... 16 56082

(51) Int. Cl.

| | |
|---|---|
| ***E05B 77/14*** | (2014.01) |
| ***E05B 79/10*** | (2014.01) |
| ***E05B 81/04*** | (2014.01) |
| ***E05B 81/42*** | (2014.01) |
| ***E05B 81/66*** | (2014.01) |
| ***E05B 81/16*** | (2014.01) |
| ***E05B 81/70*** | (2014.01) |
| ***E05B 81/14*** | (2014.01) |
| ***E05B 81/68*** | (2014.01) |
| *E05B 83/18* | (2014.01) |
| *E05B 83/36* | (2014.01) |

(52) U.S. Cl.

CPC ..... *E05B 81/66* (2013.01); *E05B 81/14* (2013.01); *E05B 81/16* (2013.01); *E05B 81/68* (2013.01); *E05B 81/70* (2013.01); *E05B 83/18* (2013.01); *E05B 83/36* (2013.01)

(58) Field of Classification Search

USPC ..... 307/116

See application file for complete search history.

(56) References Cited

U.S. PATENT DOCUMENTS

2007/0018790 A1* 1/2007 LaFrance ..... B60R 25/10 340/5.72
2017/0251092 A1* 8/2017 Elie ..... H04W 4/80

FOREIGN PATENT DOCUMENTS

| | | | |
|---|---|---|---|
| CN | 102704757 A | | 10/2012 |
| CN | 204627211 U | | 9/2015 |
| CN | 204754508 U | | 11/2015 |
| JP | 2000234464 | * | 8/2000 |
| JP | 2000234464 A | | 8/2000 |

(Continued)

OTHER PUBLICATIONS

Search Report regarding related FR App. No. 16/56082 dated Feb. 28, 2017; 2 pgs.

(Continued)

*Primary Examiner* — Rexford N Barnie
*Assistant Examiner* — Xuan Ly
(74) *Attorney, Agent, or Firm* — Cantor Colburn LLP

(57) ABSTRACT

A verification system for a vehicle latch is provided. The system includes a switch operable to determine if a vehicle door is ajar. The system also includes a cam operatively coupled to a power release mechanism that actuates movement of the vehicle latch between an opened and closed position, the cam in operable contact with the switch, the switch also determining if the vehicle latch is in a fully reset condition or an un-reset condition.

6 Claims, 1 Drawing Sheet

(56) References Cited

FOREIGN PATENT DOCUMENTS

KR 20110021482 A 3/2011

OTHER PUBLICATIONS

Written Opinion regarding related FR App. No. 16/56082 dated Feb. 28, 2017; 14 pgs.
English translation of First Office Action regarding related CN App. No. 201710504186.8; dated Nov. 28, 2018; 8 pgs.
Search Report for First Office Action regarding related CN App. No. 201710504186.8; dated Nov. 28, 2018.

* cited by examiner

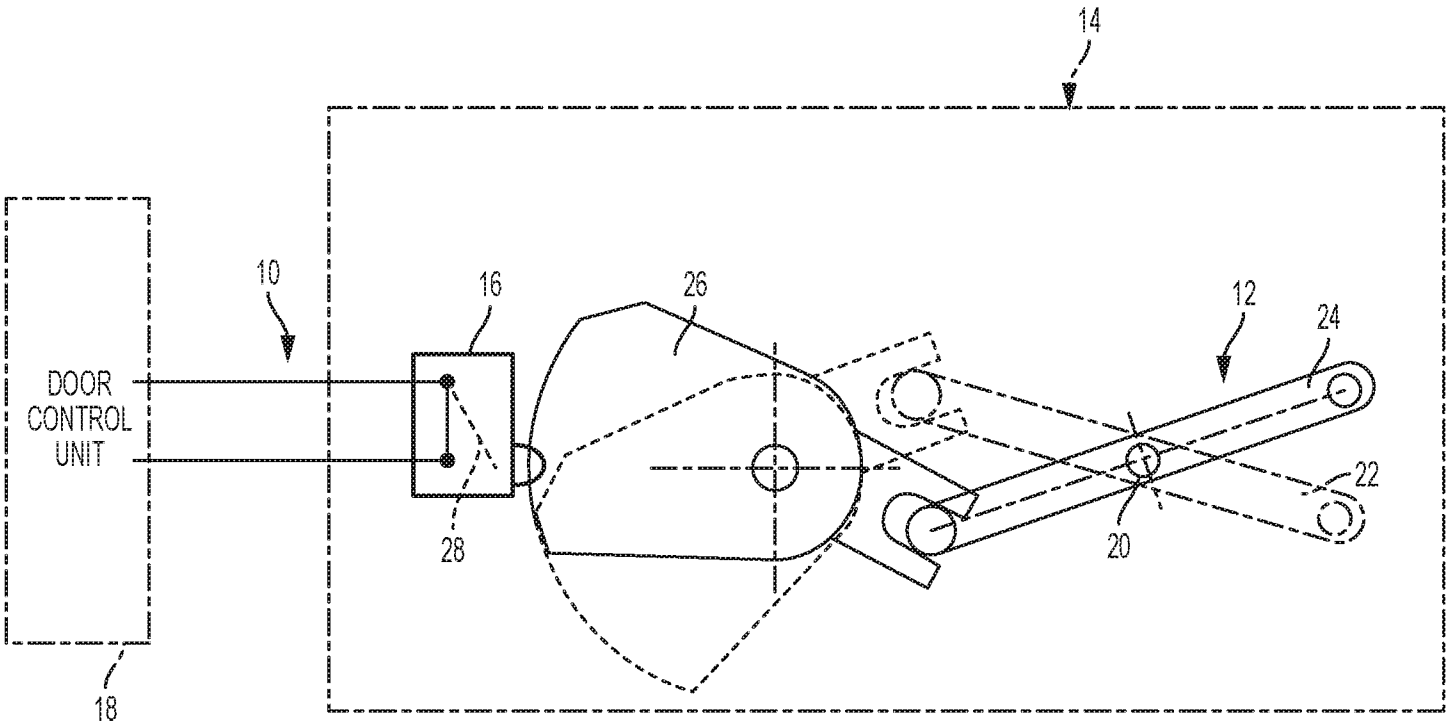
14
12
24
22
20
26
16
28
10
DOOR CONTROL UNIT
18

VERIFICATION SYSTEM FOR A VEHICLE LATCH AND METHOD

CROSS REFERENCE TO RELATED APPLICATIONS

This application claims foreign priority to French Patent Application No. 16/56082 filed on Jun. 29, 2016 under 35 U.S.C. § 119, the entire contents of which are incorporated herein by reference thereto.

BACKGROUND

The subject matter disclosed herein relates to latch assemblies and, more particularly, to a verification system for a vehicle latch, as well as methods associated therewith.

Some vehicle latch assemblies include a power release system that is returned (i.e., reset) after power release activation. Various solutions have been employed to ensure return, but each comes with certain undesirable aspects related to a tradeoff between cost and reliability.

Some systems include a self-return feature based on a return spring that is strong enough to return the system at any condition. Since such a system is relied upon as a failsafe to guarantee that the system is returned all of the time, a reset sensor is not included, thereby diminishing reliability, as this solution is sensitive to contamination (e.g., dust, ice, etc.) or return condition change due to temperature changes, for example.

Other systems are more expensive that that described above, but are more reliable. For example, a dedicated system provides a signal to a door control unit (DCU) when the latch has been fully reset. Therefore, one or more additional switches and additional wiring is required between the latch and the DCU.

SUMMARY

According to one embodiment, a verification system for a vehicle latch is provided. The system includes a switch operable to determine if a vehicle door is ajar. The system also includes a cam operatively coupled to a power release mechanism that actuates movement of the vehicle latch between an opened and closed position, the cam in operable contact with the switch, the switch also determining if the vehicle latch is in a fully reset condition or an un-reset condition.

In addition to one or more of the features described above, or as an alternative, further embodiments may include that the switch is located within the latch.

In addition to one or more of the features described above, or as an alternative, further embodiments may include that the cam is driven by a reset lever of the power release mechanism.

In addition to one or more of the features described above, or as an alternative, further embodiments may include that the switch is in operative communication with a door control unit.

In addition to one or more of the features described above, or as an alternative, further embodiments may include that the switch is in wired communication with the door control unit.

In addition to one or more of the features described above, or as an alternative, further embodiments may include that the switch is in wireless communication with the door control unit.

In addition to one or more of the features described above, or as an alternative, further embodiments may include that the door control unit detects if a switch circuit of the switch is in a closed condition or an open condition.

In addition to one or more of the features described above, or as an alternative, further embodiments may include that the switch circuit in the open condition indicates that the door is closed and the vehicle latch is in the fully reset condition.

In addition to one or more of the features described above, or as an alternative, further embodiments may include that the switch circuit in the closed condition indicates that the door is ajar or the vehicle latch is in the un-reset condition.

In addition to one or more of the features described above, or as an alternative, further embodiments may include that an alert is generated if the switch circuit is in the closed condition.

According to another embodiment, a method of verifying full resetting of a power release vehicle latch is provided. The method includes determining if a vehicle door is ajar with a switch. The method also includes determining, with the switch, if the power release vehicle latch has been fully reset to a closed position.

In addition to one or more of the features described above, or as an alternative, further embodiments may include that the switch is in operative communication with a door control unit, the method further comprising determining with the door control unit whether a switch circuit of the switch is in a closed condition or an open condition.

In addition to one or more of the features described above, or as an alternative, further embodiments may include that the switch circuit in the open condition indicates that the door is not ajar and the vehicle latch is in the fully reset condition, and wherein the switch circuit in the closed condition indicates that the door is ajar or the vehicle latch is in the un-reset condition.

In addition to one or more of the features described above, or as an alternative, further embodiments may include generating an alert if the switch circuit is in the closed condition.

In addition to one or more of the features described above, or as an alternative, further embodiments may include opening or closing the switch with a cam driven by a power release mechanism, the cam in operable contact with the switch.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawing in which:

FIG. 1 is a schematic illustration of a verification system for a vehicle latch power release system.

The detailed description explains embodiments of the invention, together with advantages and features, by way of example with reference to the drawing.

DETAILED DESCRIPTION OF THE INVENTION

Referring now to FIG. 1, reference numeral 10 generally designates a verification system for a vehicle latch power release system 12. The verification system 10 ensures that that a complete return of the vehicle latch power release system 12 is performed after a power release activation of a vehicle latch 14. The verification system 10 is generally designed for use on a vehicle (not illustrated) having a vehicle door. The verification system 10 may be installed on the driver side door, passenger side door, or rear passenger doors. Additionally, the verification system 10 may be installed in alternative locations of the vehicle, such as a vehicle door opening on the B-pillar or may be used in conjunction with a rear door of the vehicle, such as a liftgate, trunk or tailgate, for example.

The vehicle latch 14 is schematically shown and includes various components that are not illustrated in detail, but are briefly described herein for reference. For example, a housing that helps protect the vehicle latch 14 from damage, as well as dirt and debris may be provided. The housing is mounted to the vehicle door, such as with a plurality of mechanical fasteners or welding, for example. A rotatable claw releasably retains a striker to hold the door (or liftgate, trunk, tailgate, etc.) in a closed position. The claw is held in the closed position by a pawl. The pawl is actuated to disengage from the claw, thereby allowing the claw to be released and biased toward an open position. This operation releases the striker from the claw and facilitates an opening of the vehicle door.

The vehicle door is movable between a closed condition and an opened condition. In the closed condition, the vehicle door is in a position where it is not ajar. In the opened condition, the vehicle door is ajar. However, these conditions are not determinative of whether the vehicle latch 14 is fully engaged to be "closed." Specifically, the pawl, claw and striker are fully engaged in the manner described above in the closed position of the vehicle latch 14. In the opened condition, full engagement is not present. To ensure that the door is closed, a switch 16 is included to determine if the vehicle door is in an ajar condition. The switch 16 is a standard component in many vehicle latches and may be referred to as a "door ajar switch." The switch 16 is in operative communication with a door control unit 18 dedicated to control operation of the vehicle latch 14 and/or other vehicle access functions.

The power release system 12 allows for electronic actuation of the vehicle latch 14. In particular, the power release system 12, upon command, actuates the vehicle latch 14 to move between the closed (reset) and opened (un-reset) positions. Upon closure of the vehicle door, the power release system 12 actuates the vehicle latch 14 to a fully engaged condition, referred to herein as being reset. In particular, a reset lever 20 is pivotable between a reset position 22 and an un-reset position 24. Proper operation of the vehicle latch 14, and therefore the reset lever 20 actuating the latch, is sensitive to the presence of contamination, such as dust, dirt, debris, water or the like, thereby making verification of latch reset important.

In addition to determining if the door is ajar, the switch 16 is employed in the embodiments disclosed herein to determine if the vehicle latch 14 has been properly reset. To accomplish this, the switch is in operative contact with a cam 26 of the vehicle latch 14. The cam 26 actuates the switch 16 when the vehicle door is in the opened condition. With the cam 26 operatively coupled to the reset lever 20, the switch 16 is capable of detecting whether the reset lever 20 is in the reset position 22 or the un-reset position 24. In the illustration, the position of the vehicle latch components in the un-reset position 24 is shown in solid lines, while the position of the vehicle latch components in the reset position 22 is shown in phantom. In the un-reset position 24, the cam 24 is engaged with the switch 16 to close the circuit 28 of the switch 16, as shown. In the reset position 22, the cam 26 is not engaged with the switch 16, thereby maintaining the circuit of the switch 16 in an open condition.

The signal logic of the switch 16 allows for determination between two conditions. First, with a closed circuit of the switch 16, the door is opened or the vehicle latch 14 is in the un-reset position 24. In such a condition, the latch status is considered as not properly closed and a warning may be provided. For example, a dashboard indicator may be present in such a condition to alert an operator of the need to take action. A second condition is detected with an open circuit of the switch 16. In such a condition, verification has been made that the door is closed and the vehicle latch 14 is in the reset position 22. In such a condition, the latch status is considered as fully safe.

Advantageously, a single switch that is already integrated into many vehicle latches is employed to ensure that the door is closed and that the vehicle latch has been fully reset. Therefore, the embodiments described herein provide an enhanced verification system with a very limited cost impact.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A verification system for a vehicle latch comprising:

a switch operable to determine an ajar condition of a vehicle door, wherein the switch is in operative communication with a door control unit; and a cam operatively coupled to a power release mechanism that actuates movement of the vehicle latch between an opened and closed position, the cam having a curved surface in operable contact with the switch, the switch also determining a fully reset condition or an un-reset condition of the vehicle latch, the door control unit detecting when a switch circuit of the switch is in a closed condition or an open condition, wherein the switch circuit in the open condition indicates that the door is closed and the vehicle latch is in the fully reset condition, wherein the switch circuit in the closed condition indicates that the door is ajar or the vehicle latch is in the un-reset condition, the closed condition present when the curved surface of the cam is in direct contact with the switch.

2. The verification system of claim 1, wherein the switch is located within the latch.

3. The verification system of claim 1, wherein the cam is driven by a reset lever of the power release mechanism.

4. The verification system of claim 1, wherein the switch is in wired communication with the door control unit.

5. The verification system of claim 1, wherein the switch is in wireless communication with the door control unit.

6. The verification system of claim 1, wherein an alert is generated when the switch circuit is in the closed condition.

* * * * *